United States Patent [19]

Linthicum et al.

[11] 4,023,486

[45] May 17, 1977

[54] SCREEN PRINTING SQUEEGEE APPARATUS

[75] Inventors: Herbert W. Linthicum, Atlanta; George B. Vogeleer, Doraville, both of Ga.

[73] Assignee: E.T. Barwick Industries, Atlanta, Ga.

[22] Filed: Aug. 1, 1974

[21] Appl. No.: 493,676

[52] U.S. Cl. ..... 101/120; 101/123; 101/124

[51] Int. Cl.[2] ..... B41F 15/42

[58] Field of Search ..... 101/115, 116, 119, 120, 101/122, 123, 124

[56] References Cited

UNITED STATES PATENTS

| | | | |
|---|---|---|---|
| 2,928,340 | 3/1960 | Stein et al. | 101/120 |
| 3,110,919 | 11/1963 | Barnby | 101/120 X |
| 3,592,132 | 7/1971 | Weber | 101/119 |
| 3,735,730 | 5/1973 | Mitter | 101/120 X |
| 3,796,153 | 3/1974 | Jaffa | 101/119 X |
| 3,848,993 | 11/1974 | Hasiotis | 101/169 UX |
| 3,866,266 | 2/1975 | Dunlap | 101/169 UX |
| 3,890,896 | 6/1975 | Zimmer | 101/120 X |
| 3,921,520 | 11/1975 | Zimmer | 101/120 |
| 3,942,439 | 3/1976 | Zimmer | 101/120 |
| 3,949,667 | 4/1976 | Zimmer | 101/119 |

*Primary Examiner*—Edgar S. Burr
*Assistant Examiner*—R. E. Suter

[57] ABSTRACT

Improved squeegee apparatus for screen printing of carpets and other materials. A reservoir for receiving printing liquid is supported in spaced apart relation with a printing screen having a perforated pattern design therein. A squeegee head having screen-contacting sealing members is suspended from the reservoir with a flexible interconnection allowing the squeegee to ride along the screen surface, as the screen and the squeegee head undergo relative movement during printing. The squeegee head is provided with pressure reactive surfaces which adjust the screen-engaging force of the squeegee head, and also the sealing of the sealing surfaces, in response to pressure of the printing liquid in the reservoir. The present squeegee apparatus is especially useful for rotary screen printing of carpets.

9 Claims, 6 Drawing Figures

SCREEN PRINTING SQUEEGEE APPARATUS

This invention relates in general to screen printing and in particular to rotary screen printing as especially applicable to printing designs on textile products such as carpets.

Screen printing processes are widely known to those skilled in the art, consisting in broad definition of a printing screen or sheet of material which is impervious to a printing liquid such as dye or ink at all locations other than the locations of a particular pattern to be printed. The printing pattern is typically outlined on the screen by a number of perforations. The screen is overlaid on a surface to be printed and the liquid printing is forced through the screen perforations onto the surface, so that the pattern of screen perforations becomes printed onto the surface. The printing screen is typically wiped with a squeegee of some type, to obtain a uniform distribution of printing liquid through the entire perforated area of the screen.

Basic screen printing techniques have been applied to provide rotary screen printing apparatus wherein the perforated printing screen takes the form of a closed-loop screen, typically although not necessarily of cylindrical configuration, which rotates along a path providing contact between the periphery of the printing screen and a web of material to be printed. The pattern defined by the screen perforation is thus repetitively painted on the web-fed material, as is known to those skilled in the art. The dye or other printing liquid is applied to the inside of the rotary screen through a squeegee apparatus which extends along the entire longitudinal axis of the rotary screen, or at least along a longitudinal extent sufficient to encompass the width of the web of material being printed by the rotary screen. The squeegee apparatus may define a narrow longitudinally-extending elongated slot in sliding contact with the interior surface of the printing screen, with a supply of printing liquid being fed to the the slot for screen penetration. The slot of the squeegee defines a closed area on the screen surface, aligned with the tangential web-screen contact region, through which printing liquid flows to print the screen pattern on the web of material. Rotary screen printing apparatus is known which has several successive rotary screen printing stations, so that complex patterns may be sequentially printed on a web of material in a single pass through the printing apparatus.

Rotary screen printing apparatus was initially designed and used for printing relatively flat web material having a substantially smooth and flat surface, such as paper, woven fabrics, and the like. It soon became apparent that the advantages of rotary screen printing, such as the ability to print multiple designs or design segments on a continuously-moving web at a single pass, would be advantageously applied to printing designs on other textile products such as carpet. Considerable difficulties have been encountered, however, in prior attempts to use rotary screen printing apparatus for printing on material having a non-smooth or unflat surface, such as on carpet and especially on carpet having a substantial pile and on shag carpet. Satisfactory printing of carpet requires dye penetration through substantially the entire extent of the carpet pile. In an attempt to obtain satisfactory dye penetration, it was found necessary to increase the pressure at which the liquid dye material was applied through the squeegee to the inner side of the rotary printing screen. Increased dye pressures with slot-type squeegees, however, caused the dye to leak from the squeegee around the seal area defining the squeegee slot, and the escaping dye randomly flows through screen perforations beyond the squeegee slot area to cause blotching and other imperfections in the pattern being printed on the carpet.

Prior art attempts to obtain satisfactory printing of carpet have generally involved expedients such as forcibly engaging the squeegee against the surface of the rotary printing screen in an attempt to minimize leakage of dye from the squeegee, and applying dye liquid to the squeegee under increased liquid pressure. Since prior art squeegees used with rotary screen printing consist generally of a rigid structural member which extends through the entire longitudinal span of a rotary screen and which is supported only at the squeegee ends located beyond the ends of the screen, and since the overall unsupported span of a squeegee supported within a rotary screen for printing twelve-foot wide carpet may approach fifteen feet, it has been found that such prior-art squeegees undergo a significant amount of vertical deflection in response to the amount of liquid pressure applied within the squeegee. This vertical deflection causes the squeegee to move away from the screen at some locations, thereby reducing the squeegee-screen sealing at such locations and causing irregular dye leakage. The support structure of prior-art rotary screen squeegees includes numerous micrometer-type adjustments which allow the precise position of each end of the supported squeegee to be independently adjusted relative to the printing screen, so that machine operators can attempt to "fine-tune" the squeegee to an optimum printing position. Such fine tuning, however, requires considerable trial-and-error adjustment by highly skilled craftsmen at the outset of each carpet printing operation, and the carpet printed during the tuning operation must be scrapped. Moreover, such squeegees frequently require constant attention and further adjustment during each printing run.

Various expedients have been proposed and tried in an attempt to maintain a controlled and uniform squeegee pressure against the rotary printing screen, and to prevent the dye liquid from leaking through the squeegee-screen seal. One such expedient, for example, involves placing a series of electromagnets beneath the bed of the rotary screen printing machine, in alignment with the printing screen and the squeegee extending therethrough. By applying a controlled current to the electromagnets, and thereby exerting an attractive force on the squeegee which is above the bed of the printing machine, it was hoped that pressure deflection of the squeegee apparatus could be overcome. Such prior art attempts at increasing screen-squeegee pressure, however, cause the rotary screen to be forced against the carpet with force sufficient to depress the carpet pile at the location of printing contact. When the depressed pile returns to a normal upright position after printing, the printed pattern presents a blurred appearance which is unsatisfactory.

Accordingly, it is an object of the present invention to provide an improved squeegee for use with screen printing apparatus.

It is another object of the present invention to provide an improved squeegee for use with rotary screen printing apparatus.

It is still another object of the present invention to provide an improved squeegee particularly useful for rotary screen printing of carpet and other products.

Other objects and advantages of the present invention will become apparent from consideration of the following description of the disclosed embodiment, wherein.

Stated in general terms, the squeegee apparatus of the present invention includes a reservoir which can be rigidly mounted in spaced-apart relation to a printing screen, and which is connectable to a suitable source of printing liquid. A squeegee head assembly is movably connected to the reservoir to rest upon the perforate surface of the printing screen, and the inerconnection of the squeegee head assembly and the reservoir allows the head assembly to ride along the screen and to undergo a limited extent of movement relative to the reservoir during printing operations. The squeegee head assembly includes seal structure for retaining the printing liquid within a predetermined location on the surface of the printing screen, as well as bearing structure for supporting the squeegee head assembly on the printing screen. The amount of force exerted on the printing screen by the squeegee head assembly of the present invention is controlled by the pressure of dye liquid applied to the squeegee head assembly from the reservoir apparatus, and the movable interconnection between the reservoir and the head assembly isolates the squeegee head assembly from bending or other displacement of the reservoir. The squeegee head assembly is urged into contact with the printing screen in response to force developed within the squeegee head assembly by the applied pressure of the printing liquid.

Figure 1:
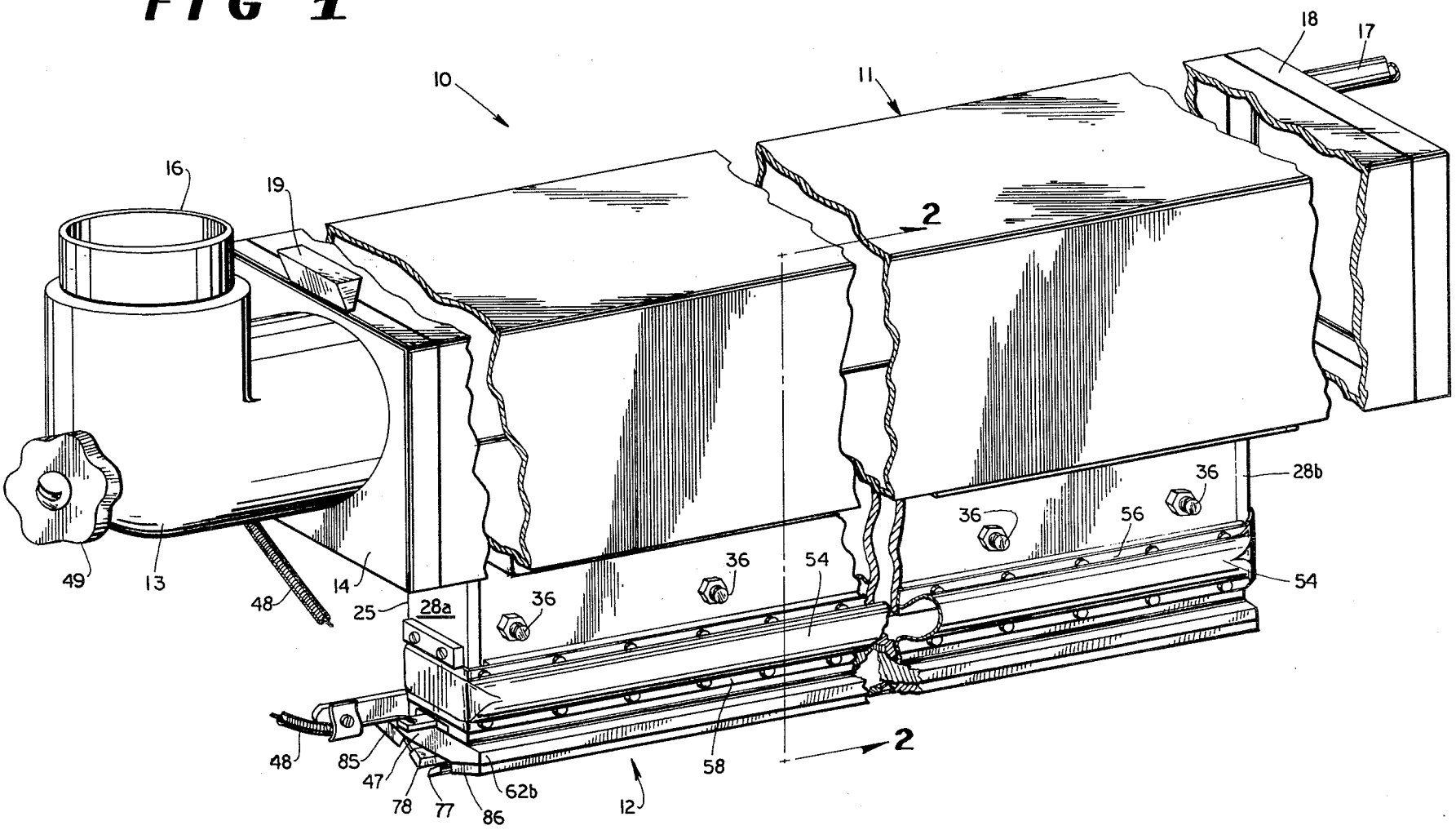
FIG. 1 shows a pictorial view of a squeegee according to the disclosed embodiment of the present invention.

The present invention is more particularly understood with reference to the following description of the disclosed embodiment as shown in FIG. 1, wherein a squeegee assembly is indicated generally at 10 and includes a liquid reservoir 11 and a squeegee head assembly 12. The squeegee assembly 10 of the disclosed embodiment is designed for use with a rotary screen printing application, and so the squeegee assembly is of elongate configuration to extend longitudinally through the closed rotary screen (not shown in FIG. 1). The reservoir 11 has a rectangular cross-section, although the sectional configuration of the reservoir is not considered to be a limitation of the present invention. A pipe 13 is connected to an end 14 of the reservoir 11 for flow communication with the interior region 15 of the reservoir. The pipe 13 terminates at an open end 16 that is turned facing upwardly, in the disclosed embodiment, and which is provided with suitable coupling structure for connection with a source of dye or other printing liquid. A support member 17 is attached to the reservoir 11 and is connected to extend outwardly from the other end 18 of the reservoir. The squeegee assembly 10 is supported within a rotary printing screen 27 while in use (see FIG. 2), by mounting structure which receives and is removably connected to the support member 17 and to the pipe 13. The mounting structure forms no part of the present invention and is not shown herein. It is preferred that the reservoir 11 be supported in a relative fixed position within a rotary screen, and so a clamp receiving member 19 is affixed to an appropriate location adjacent the end 14 of the reservoir to receive a clamp or other appropriate retaining device.

Figure 2:
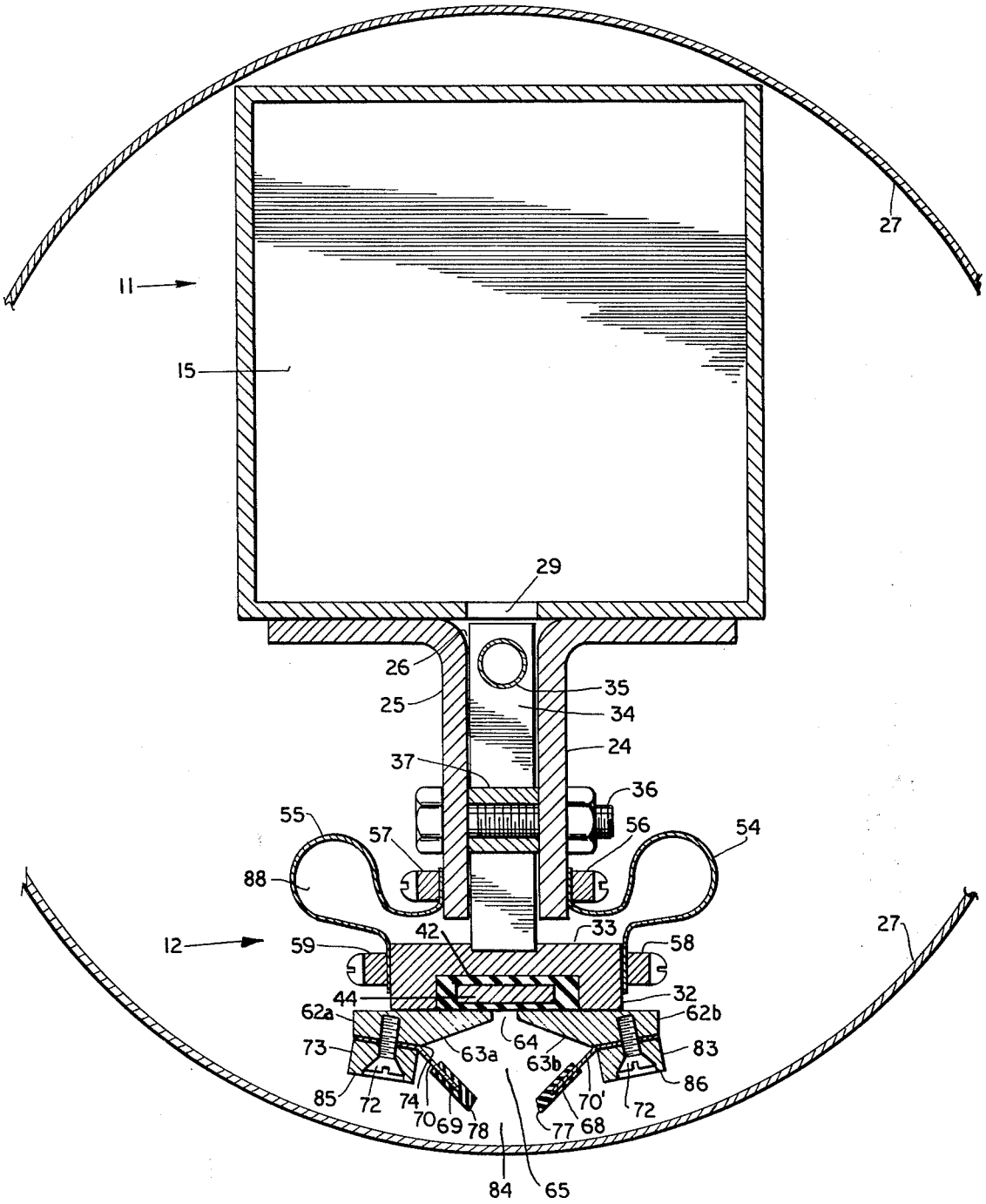
FIG. 2 is a vertical section view taken along line 2—2 of FIG. 1, with the squeegee head assembly shown raised from the rotary screen surface for illustrative purposes.
Figure 3:
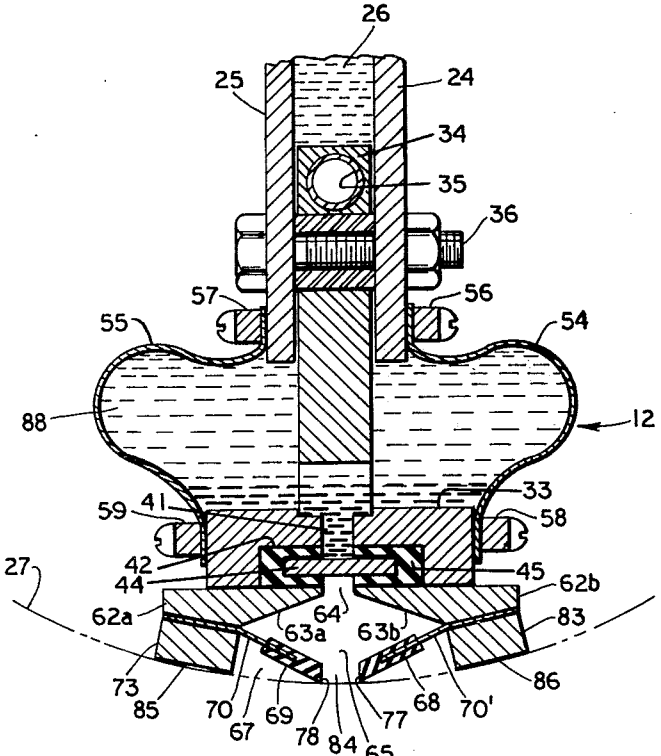
FIG. 3 is a partial section view showing the squeegee head assembly contacting with the rotary screen.

A pair of wall members 24 and 25 are mounted in downwardly depending relation to the underside of the reservoir 11. As best seen in FIGS. 2 and 3, the wall members 24 and 25 are spaced apart from each other to define a channel 26 extending along the longitudinal dimension of the wall members. The channel 26, which has an open end facing downwardly toward the rotary printing screen 27, is closed at the two longitudinal ends by the plates 28*a* and 28*b*. The upper end of the channel 26 is open and aligned with openings 29 in the bottom of the reservoir 11 for fluid flow communication with the interior region 15 of the reservoir.

Figure 4:
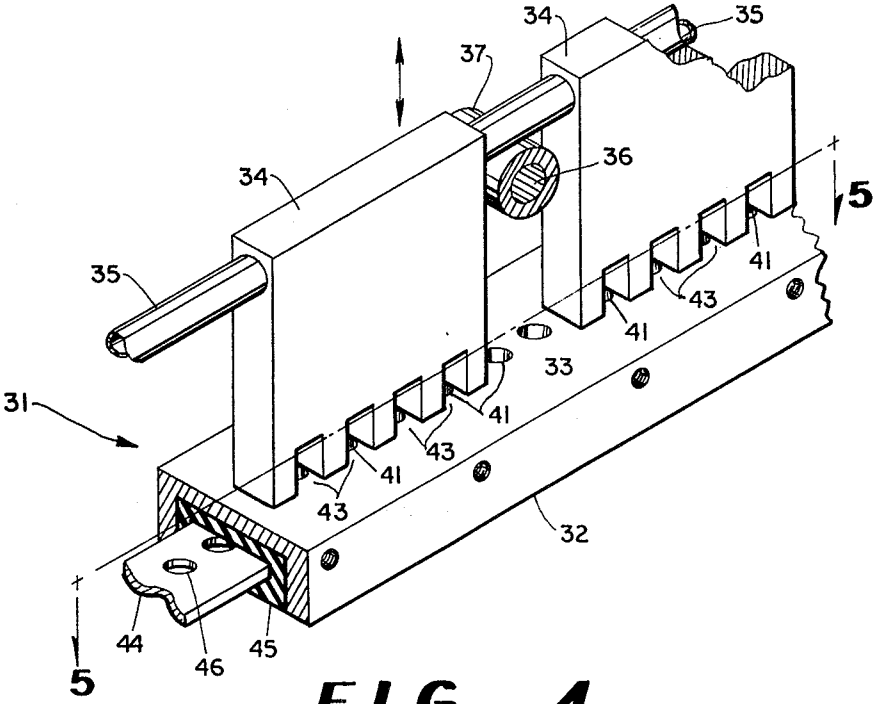
FIG. 4 is a fragmentary isometric view of certain elements of the squeegee head assembly.
Figure 5:
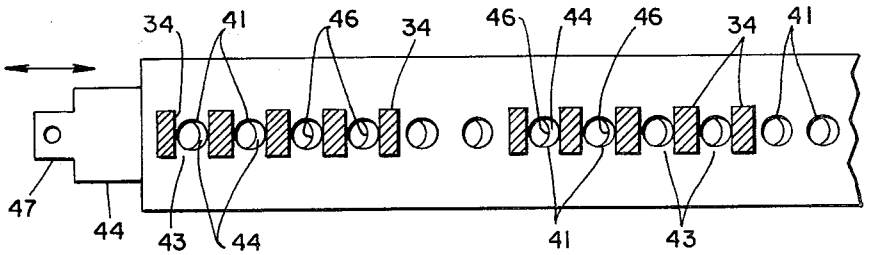
FIG. 5 is a section view taken along line 5—5 of FIG. 4, showing the construction and operation of the metering.

The squeegee head assembly 12 includes a tee assembly 31 (FIG. 4) comprising a tee base 32 which extends below and longitudinally coextensive with the channel 26. The tee base 32 has an upper surface 33 which is substantially perpendicular to the vertical orientation of the channel 26. A number of guide members 34 are fastened to the upper surface 33 at spaced-apart intervals along the length of the upper surface, as best shown in FIG. 4. The width of each guide member 34 is sufficiently less than the width of the channel 26 to permit the guide members to be freely slidable for vertical movement within the channel. The spacing between each of the guide members 34 is bridged by a suitable structural member such as the member 35, attached to the guide members adjacent the uppermost portion of the ends thereof. The bridging member 35 increases the structural strength of the tee assembly 31 and also cooperates to provide a motion stop as set forth below. A plurality of fastening members, such as the bolts 36, extend through the two wall members 24 and 25 at intervals along the length of the wall members chosen to coincide with the spaces between adjacent ones of the guide members 34. Each of the bolts 36 is surrounded by a spacer 37, and it is apparent in FIG. 4 that each bolt 36 and spacer 37 lies beneath a bridging member 35 joining together two adjacent guide members 34. The bolts 36 thus retain the tee assembly 31 in place within the channel 26, and define the maximum extent to which the tee assembly can move downwardly from the reservoir 11.

A row of openings 41 are provided in the tee base 32, extending through the tee base from the upper surface 33 into communication with a channel 42 extending longitudinally along the underside of the tee base. As shown in FIG. 4, each of the guide members 34 is provided with cutaway portions 43 above each of the openings 41 which would otherwise be obstructed by the guide members. An elongated metering gate 44 is received within suitable fluid-tight valve packing 45 within the channel 42. The metering gate 44, in the disclosed embodiment, is an elongate member of generally rectangular cross-section, extending the entire length of the longitudinal channel 42 formed in the tee base 32. Extending through the metering gate 44 is a row of openings 46 which are equal in number and in longitudinal spacing to the openings 41 in the tee base 32. An end 47 of the metering gate 44 extends longitudinally beyond the end of the tee base 32 for operative connection with a suitable linear actuating apparatus, such as the flexible cable 48 (FIG. 1) connected to an operating control 49. Extending upwardly from the end of the metering gate, the flexible cable 48 enters the extended end portion of the reservoir 11 and passes therein for connection with the actuating member 49 which is conventiently mounted on the pipe 13 extending from the end 14 of the reservoir. Although the disclosed arrangement of flexible cable 48 passing within the reservoir and printing liquid feed pipe is not essential to the operation of the present invention, the disclosed arrangement of the flexible cable places substantially all of that cable in a protected environment.

A fluid-tight seal is maintained between the reservoir 11 and the squeegee head assembly 12 by a pair of flexible members 54 and 55 which extend along the entire length of the wall members 24 and 25 and the tee base 32. Each of the bellows members 54 and 55 can be made of any suitable flexible material, such as fabric-reinforced rubber or the like, which is unaffected by the printing liquid used in the squeegee assembly. Each of the flexible members is attached to the corresponding wall member 24 or 25 by being received between the wall member and one of the elongated strips 56 and 57 that are secured to the corresponding wall members by screws or other suitable fasteners. A similar pair of elongated strip members 58 and 59 retain the lower edge of the flexible members in sealing relation against the tee base 32. Each of the flexible members 54 and 55 has sufficient range of vertical extension, as seen in FIGS. 2 and 3, to permit the squeegee head assembly 12 to move along a range of vertical movement relative to the reservoir 11.

Attached to the underside of the tee base 32 is a lower support structure including the support member 62*a* and 62*b*, each provided by an elongate member connected to the tee base and coextensive with the length of the tee base. Each of the lower support members 62*a* and 62*b* has a beveled surface 63*a* and 63*b*, respectively, terminating at support member surfaces that are spaced apart as at 64 to define an elongate passage aligned with the openings 41 in the tee base and the openings 46 in the metering gate 44. The beveled surfaces 63*a* and 63*b* of the lower support members also provide and partially define an elongated chamber 65 which extends longitudinally along the head assembly 12. It is seen that the chamber 65 is in fluid flow communication with the interior region 15 of the reservoir 11 when the metering gate 44 is open.

Figure 6:
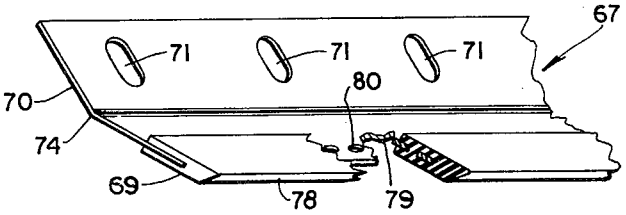
FIG. 6 is a detailed isometric view of one of the screen seals.

The chamber 65 is further defined by a pair of elongate screen seals 67 and 68, each of which extends longitudinally along the length of the head assembly 12. The screen seal 67, for example, is seen in FIG. 6 to include a seal member 69 secured along the forward edge 79 of a longitudinal resilient mounting member 70. The mounting member 70 has a number of elongate slots 71 formed adjacent the edge opposite the seal member 69, and it can be seen from FIG. 2 that the mounting member 70 is attached to the lower support member 62*a* by a number of fasteners 72 which extend through the bearing block 73 and are retained within the lower support member. The mounting member 70 is bent downwardly at 74 (as seen in FIGS. 2 and 3) to bias the seal member 69 downwardly toward the printing screen 27. As is pointed out below, the seal member 69 and the corresponding seal member 77 of the screen seal 68 are normally biassed downwardly to a position whereat the forward edge 78 of each seal member is the first element of the squeegee head assembly 12 to contact the printing screen 27, when the head assembly is lowered from the position shown in FIG. 2 to the screen contacting position shown in FIG. 3. The mounting member 70 for each screen seal must resiliently urge the members 69 and 77 into contact with the printing screen, and the mounting members obviously must not be corroded or otherwise attached by the printing liquids used with the squeegee assembly. Mounting members 70 made of a resilient, yieldable, corrosion-resistant material such as stainless steel are suitable for the purposes.

The seal members 69 and 77 are preferably made of a material having the properties of a low coefficient of friction, durability to wear, and resistance to attack by the printing liquids. Materials such as polytetrafluoroethylene (Teflon), PVC, and ultra-high molecular weight polyethylene are examples of suitable materials for the seal members. As shown in FIG. 6, the seal member 69 in the disclosed embodiment has a longitudinal slit within which the forward edge 79 of the mounting 70 is received. The seal member 69 may be secured to the forward edge 70 by any appropriate means. For example, a number of openings 80 can be provided at longitudinally-spaced intervals along the extent of the forward edge 79, and the material of the seal member 69 can be bonded together through the openings 80 by known techniques such as ultrasonic or thermal welding. Alternatively, the seal member 69 can be secured to the forward edge 79 of the mounting member 70 by using fastener members such as rivets extending through the openings 80 and corresponding openings (not shown) in the seal member.

The mounting member 70′ of the screen seal 68 is identical to the mounting member 70 and is connected to the lower support member 62*b* by screws or other fasteners extending through the bearing member 83 and the elongate slots 71, as previously described with respect to the mounting member 70. The provision of the elongate slots 71 in each of the mounting members 70 and 70′ permits adjustment of the width of the screen-engaging slot 84 defined between the opposed forward edges of the seal members 69 and 77. The two ends of the slot 84 are defined by a pair of end seals, one of which is shown at 86 in FIG. 1.

Each of the bearing members 73 and 83, which support substantially the entire weight of the squeegee head assembly 12 on the printing screen 27, are also made of a material having a low coefficient of friction, durability to wear, and resistance to attack by printing liquids. Each of the bearing members 73 and 83 may be made of materials such as described above with respect to the seal members 68 and 69. The screen-contacting surfaces 85 and 86 are angularly disposed to conform substantially with the curvature of the rotary printing screen 27.

Considering the operation of the squeegee assembly as described herein, it will be understood that the squeegee assembly is positioned within a rotary printing screen 27 and retained in place by suitable attachment with the support members 17 and 19, for example. The reservoir 11 is immovably mounted within the rotary printing screen 27 at this time, and the tee assembly 31 gravitates downwardly to rest on the inner surface of the printing screen as shown in FIG. 3. Although the screen seals 67 and 68 contact the screen surface at this time, deflecting the yieldable mounting members 70 and 70' to the position shown in FIG. 3, substantially the entire weight of the assembly is supported on the screen by the bearing members 73 and 83. Assuming that the pipe 13 is connected to a suitable pressurized source of dye or other printing liquid, the interior region 15 of the reservoir 11 becomes filled with printing liquid under pressure. The pressurized printing liquid flows through the opening 29 to enter the channel 26 and to enter and fill the volume 88 defined by the upper surface 33 of the tee base and by the two flexible member 54 and 55. Since the hydrostatic pressure of the printing liquid in the reservoir 11 is applied to the upper surface 33, it will be seen that a pressure force is exerted on the upper surface in a direction which urges the squeegee head assembly 12 downwardly away from the reservoir 11 and toward the inner surface of the printing screen 27. The amount of pressure-induced force is determined by the effective area of the upper surface 33, as well as the pressure of the printing liquid within the volume 88.

The pressurized printing liquid within the volume 88 flows through the openings 41 in the upper surface 33, in an extent determined by the longitudinal position of the metering gate 44 and the consequent alignment of the metering gate openings 46 with the openings 41, to fill the chamber 65 with pressurized liquid. The pressurized liquid within the chamber 65 is forced through the slot 84 as the slot traverses perforated regions of the printing screen 27. The pressure of the printing liquid within the chamber 65 depends on several factors, among which are the pressure of the liquid in the reservoir 11, the extent to which the openings 46 of the metering gate 44 are aligned with the openings 41 in the tee base 32, and the perforate extent of the screen area covered by the slot 8 at any particular moment. It will be seen, however, that the pressurized liquid within the chamber 65 exerts upon the resiliently-mounted seal members 68 and 69 a force further urging these seal members into sealing engagement with the printing screen 27.

The squeegee head assembly 12 is free to undergo a limited extent of vertical movement, relative to the fixed reservoir 11, in response to fluctuations in the instantaneous vertical position of the contact region of the squeegee head assembly with the rotating printing screen; such vertical movement may be caused by variations in the thickness of carpet or other material being printed, by eccentric mounting of the rotary printing screen, or by other factors. Since the downward force exerted on the screen 27 by the squeegee head assembly 12 is determined by the pressure of the printing liquid acting on the surface 33, however, the squeegee head assembly "floats" on the printing screen in response to such vertical movement without producing any substantial change in the contacting relation between the squeegee head assembly and the screen. Moreover, the sealing engagement of the screen seals 67 and 68 is also virtually unaffected by such vertical movement of the floating squeegee head assembly. Since the squeegee head assembly 12 is allowed to determine its own vertical position relative to the printing screen 27, within the limited range of vertical movement allowed between the squeegee head assembly 12 and the reservoir 11, it is unnecessary to make "fine tuning" adjustments of squeegee assembly position relative to the printing screen. The only operating control with the present squeegee assembly is the positioning of the metering gate 44, and it will be understood by those skilled in the art that the flow of printing liquid is controlled by adjusting the metering gate in response to the needs of a particular printing operation as may be determined, for example, by the linear printing speed of the web, the perforate pattern in the screen, and the nature of the material being printed. It is also contemplated that the pressure of printing liquid supplied to the reservoir 11 can be adjusted in a manner known to those skilled in the art.

It will also be understood that the foregoing relates only to a disclosed preferred embodiment of the present invention, and that numerous alterations and modifications may be made therein within the scope of the invention as defined in the following claims.

What is claimed is:

1. Squeegee apparatus for use with a perforate printing screen, comprising:

reservoir means removably mounted in fixed spaced apart proximate relation to a surface of a printing screen, said reservoir means being operative to receive a quantity of printing fluid at elevated pressure;

a squeegee head assembly having a longitudinal dimension corresponding to a predetermined dimension of said printing screen surface;

means flexibly mounting said squeegee head assembly between said reservoir means and the printing screen to allow said squeegee head assembly to ride on said screen surface for a limited extent of movement of said squeegee head assembly relative to said fixed reservoir means;

seal means carried by said squeegee head assembly and extending along said longitudinal dimension to enclose and define a fluid receiving area on said printing screen surface;

bearing means mounted on said squeegee head assembly in position to contact the printing screen surface and substantially support said squeegee head assembly thereon; and said bearing means being positioned in offset relation to said seal means to allow said first portion of said seal means to sealingly contact the printing screen surface while said squeegee head assembly is supported thereon by said bearing means;

said seal means having a first portion for fluid sealing contact with the printing screen and having a second portion defining a chamber for receiving pressurized printing fluid from said reservoir means, said second portion having an area against which said pressurized printing fluid is applied to urge said first portion into fluid sealing contact with the printing screen surface; and means establishing fluid flow communication between said reservoir means and said fluid receiving chamber, so that fluid is applied to said area of said second portion and to said fluid receiving area of said printing screen surface.

2. Apparatus as in claim 1, further comprising:

fluid metering means carried by said squeegee head assembly in selectably variable fluid flow blocking relation between said reservoir means and said seal means, so as to control the volume of pressurized printing fluid flowing to said seal means from said reservoir means.

3. In a squeegee apparatus for use with a perforate printing screen, said squeegee apparatus including a reservoir for receiving printing fluid and mounted in fixed spaced apart relation to a surface of the printing screen, a squeegee head assembly supported by the surface of the printing screen, means flexibly connecting squeegee head assembly to ride on said screen surface relative to said fixed reservoir, means defining a fluid flow path from said reservoir to said squeegee head assembly, and a seal assembly mounted on said squeegee head assembly in position to contact said printing screen surface to define a fluid receiving area thereon, the improvement in said seal assembly comprising:

at least one elongate flexible resilient strip having a first area defined by an elongate extremity and by a bend line on said strip parallel to said elongate extremity;

a plurality of openings in said strip, said openings being disposed in a row extending parallel to and positioned adjacent to said elongate extremity;

said openings receiving fastening members to secure said strip to said squeegee head assembly adjacent said printing screen surface and being elongated in a direction substantially perpendicular to the elongate extent of said strip, to allow said strip to be selectably positioned relative to said squeegee head assembly;

said strip having a second area contiguous to said first area, said second area defined by said bend line and by a second elongate extremity of said strip parallel to said first elongate extremity; and a seal member secured to said strip along and in surrounding relation with said second elongate extremity, said seal member contacting the printing screen surface.

4. The squeegee apparatus as in claim 3, wherein a plurality of additional openings in said strip are disposed in a row extending parallel with and positioned adjacent to said second elongate extremity, and said seal member surrounds said row of additional openings and is joined together through said additional openings for securement to said strip.

5. Squeegee apparatus for use with a printing screen, comprising:

reservoir means for receiving a pressurized flow of liquid and mounted in fixed spaced apart relation to a surface of a printing screen; and squeegee means supported by the surface of the printing screen and operative to apply liquid to a closed area of such printing screen;

said squeegee means including seal means which sealingly contacts such screen surface and defines the closed area of the screen surface;

means connecting said squeegee means to said reservoir means to allow said squeegee means to freely float on said screen surface, relative to the fixed location of said reservoir means, in response to movement of said screen surface as said squeegee means rides therealong;

stop means connected to said reservoir means and said squeegee means and operative to define a predetermined range of said floating squeegee means movement, relative to said reservoir means, so that said squeegee means can float on said screen surface to remain in said sealing contact with the screen surface notwithstanding variations in the spacing between the screen surface and the reservoir means within said predetermined range;

flow means defining a liquid flow path from said reservoir means to said squeegee means for application on said closed area defined on the screen surface;

bearing means mounted on said squeegee means to contact the screen surface and substantially support said squeegee means on the surface of the screen as said squeegee means moves within said predetermined range of movement; and said bearing means being disposed to contact the screen surface in spaced apart relation to said seal means.

6. Apparatus as in claim 5, wherein said squeegee means includes valve means operative to selectively adjust the flow of said liquid supplied to said closed area.

7. Squeegee apparatus for use with a printing screen comprising:

reservoir means for receiving a pressurized flow of liquid and mounted in fixed spaced apart relation to a surface of printing screen; and squeegee means supported by the surface of the printing screen and operative to apply liquid to a closed area of such printing screen;

said squeegee means including seal means which sealing contacts such screen surface and defines the closed area of the screen surface;

said seal means comprising a pair of elongate sealing members each of which is cantilever supported from said squeegee means and both of which have screen engaging seal portions disposed in mutually parallel spaced apart relation to define said closed area;

means connecting said squeegee means to said reservoir means to allow said squeegee means to freely float on said screen surface, relative to the fixed location of said reservoir means, in response to movement of said screen surface as said squeegee means rides therealong;

stop means connected to said reservoir means and said squeegee means and operative to define a predetermined range of said floating squeegee means movement, relative to said reservoir means, so that said squeegee means can float on said screen surface to remain in said sealing contact with the screen surface notwithstanding variations in the spacing between the screen surface and the reservoir means within said predetermined range;

flow means defining a liquid flow path from said reservoir means to squeegee means for application on said closed area defined on the screen surface;

bearing means mounted on said squeegee means in substantially parallel relation with said sealing members and operative to support at least a substantial portion of the weight of said squeegee means on the screen surface as said squeegee means moves within said predetermined range of movement; and said sealing members being resiliently biassed by said cantilever support to extend a distance beyond said bearing means to be resiliently displaced by contact of said screen engaging portions with the screen surface.

8. Apparatus as in claim 7, wherein:

said bearing means comprises a pair of elongate screen contacting bearing members mounted on said squeegee means on opposite sides of said pair of elongate sealing members for contacting the screen surface in spaced apart relation to said elongate sealing members.

9. Squeegee apparatus for use with a printing screen, comprising:

reservoir means for receiving a pressurized flow of liquid and mounted in fixed spaced apart relation to a surface of a printing screen; and squeegee means supported by the surface of the printing screen and operative to apply liquid to a closed area of such printing screen;

means interconnecting said squeegee means to said reservoir means for a limited range of movement relative to said reservoir means, so that the squeegee means can freely move along said path throughout said range of movement to remain in contact with the screen surface notwithstanding variations in spacing between the screen surface and said reservoir means within said range of movement;

said reservoir means and said squeegee means each having an elongated extent;

said squeegee means including seal means which sealingly contacts such screen surface and defines the closed area of the screen surface;

flow means defining a liquid flow path from said reservoir means to said squeegee means for application on said closed area defined on the screen surface;

flexible liquid imperivous means externally surrounding the connection between said squeegee means and said reservoir means and extending in liquid sealing relation between said reservoir means and said squeegee means so as to partially define said liquid flow path from said reservoir means to sad squeegee means;

said flexible liquid impervious means partially defining a chamber which is in communication with said liquid flow path and which receives said pressurized liquid; and said squeegee means having a pressure receiving surface which is exposed to said pressurized liquid within said chamber and which has an effective area aligned to urge said squeegee means away from said reservoir means and toward the printing screen in response to the force exerted on said area by said pressurized liquid within said chamber.

* * * * *